US005338124A

United States Patent [19]

Spicer et al.

[11] Patent Number: 5,338,124

[45] Date of Patent: Aug. 16, 1994

[54] WATER SQUIRT TOOTHBRUSH

[76] Inventors: Zorroz W. Spicer, 675 Lincoln Ave. #2R, Brooklyn, N.Y. 11208; George Spector, 233 Broadway Rm. 702, New York, N.Y. 10279

[21] Appl. No.: 78,058

[22] Filed: Jun. 17, 1993

[51] Int. Cl.[5] ..... A46B 1/02

[52] U.S. Cl. ..... 401/280; 401/146; 401/184; 401/186

[58] Field of Search ..... 401/184, 149, 150, 280, 401/186, 146

[56] References Cited

U.S. PATENT DOCUMENTS

| | | | |
|---|---|---|---|
| 2,226,663 | 12/1940 | Hill et al. | 401/184 |
| 2,569,276 | 9/1951 | Baptist | 401/184 |
| 2,823,401 | 2/1958 | O'Higgins | 401/280 |
| 3,400,996 | 9/1968 | Vandergrift | 401/184 |
| 3,903,888 | 9/1975 | Buelow et al. | 401/150 X |
| 4,221,492 | 9/1980 | Boscardin et al. | 401/184 |

FOREIGN PATENT DOCUMENTS

| | | | |
|---|---|---|---|
| 144302 | 9/1903 | Fed. Rep. of Germany | 401/184 |
| 159914 | 4/1933 | Switzerland | 401/184 |
| 221269 | 1/1943 | Switzerland | 401/184 |

*Primary Examiner*—Steven A. Bratlie

[57] ABSTRACT

A water squirt toothbrush is provided which consists of a handle having a longitudinally extending fluid chamber. A head is attached to a first end of the handle having a longitudinally extending fluid channel connected to the fluid chamber and a plurality of lateral fluid passageways extending inwardly from one face and terminating in the fluid channel. A plurality of bristles extend outwardly from the one face of the head. A mechanism in cooperation with the fluid chamber of the handle and the fluid channel in the head is for squirting water through the lateral fluid passageways past the bristles to rinse off teeth being brushed by the bristles.

2 Claims, 1 Drawing Sheet

WATER SQUIRT TOOTHBRUSH

BACKGROUND OF THE INVENTION

The instant invention relates generally to dental care equipment and more specifically it relates to a water squirt toothbrush which provides a pump mechanism for squirting water through the bristles of a toothbrush.

There are available various conventional dental care equipment which do not provide the novel improvements of the invention herein disclosed.

SUMMARY OF THE INVENTION

A primary object of the present invention is to provide a water squirt toothbrush that will overcome the shortcomings of the prior art devices.

Another object is to provide a water squirt toothbrush that contains a pump mechanism for squirting water through the bristles of the toothbrush to rinse off teeth being brushed by the bristles.

An additional object is to provide a water squirt toothbrush in which a person using the toothbrush can control the amount of water being squirted through the bristles.

A further object is to provide a water squirt toothbrush that is simple and easy to use.

A still further object is to provide a water squirt toothbrush that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
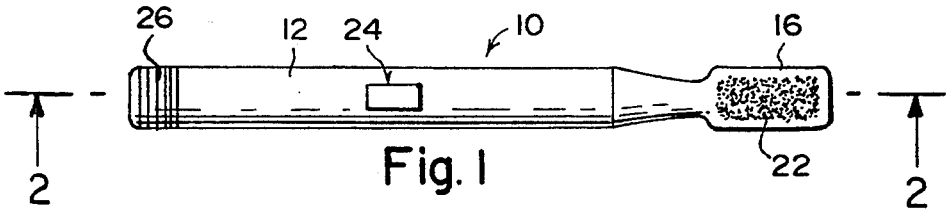
FIG. 1 is a plan view of the instant invention.

Turning now descriptively to the drawings, in which similar reference characters denote similar elements throughout the several views, the Figures illustrate a water squirt toothbrush 10 which consists of a handle 12 having a longitudinally extending fluid cheer 14. A head 16 is attached to a first end of the handle 12 having a longitudinally extending fluid channel 18 connected to the fluid chamber 14 and a plurality of lateral fluid passageways 20 extending inwardly from one face and terminating in the fluid channel 18. A plurality of bristles 22 extend outwardly from the one face of the head 16. A mechanism 24 in cooperation with the fluid chamber 14 of the handle 12 and the fluid channel 18 in the head 16 is for squirting water through the lateral fluid passageways 20 past the bristles 22 to rinse off teeth being brushed by the bristles 22.

Figure 2:
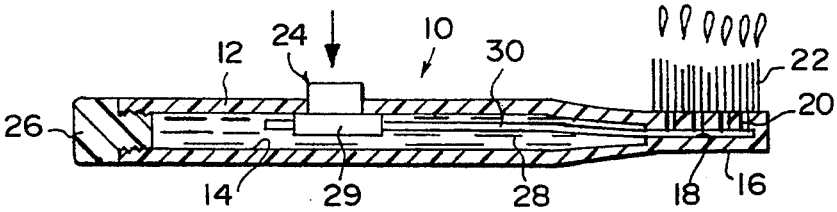
FIG. 2 is a cross sectional view taken along line 2—2 in FIG. 1 showing the internal pump mechanism.

A removable cap 26 is threaded onto a second end of the handle 12, so that water 28 can be introduced within the fluid chamber 14 in the handle 12 when needed. The water squirting mechanism 24, as best seen in FIG. 2, includes a pump 29 carried within the fluid chamber 14 of the handle 12. An elongate tube 30 is fluidly connected at a first end to the pump 29, with a second end extending into the fluid channel 18 of the head 16. A trigger button extends from the pump 29 through one side of the handle 12. A hand of a person gripping the handle 12 can press the trigger button to operate the pump 29 to squirt water through the elongate tube 30 into the fluid channel 18 and through the lateral fluid passageways 20.

Figure 3:
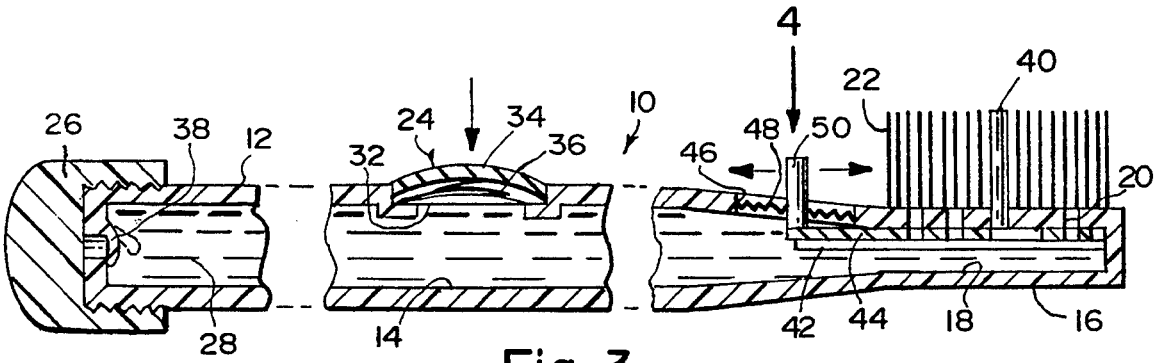
FIG. 3 is an enlarged cross sectional view with parts broken away showing a modification utilizing a slide member and a flexible jet tube to control the flow of water through the bristles.
Figure 4:
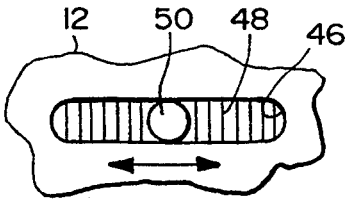
FIG. 4 is a partial plan view taken in direction of arrow 4 in FIG. 3 showing the knob and the accordion plate within the slot of the toothbrush handle.

The water squirting mechanism, best seen in FIG. 3, contains the handle 12 having an aperture 32 in one side thereof. A flexible membrane 34 is retained to and covers the aperture 32 in the handle 12. A spring 36 is retained in the aperture 32 under the flexible membrane 34. A hand of a person gripping the handle 12 can press the flexible membrane 34 to squirt water from the fluid chamber 14 into the fluid channel 18 and through the lateral fluid passageways 20.

A one-way flap valve 38 is mounted at the second end of the handle 12. When the water 28 is introduced within the fluid chamber 14 in the handle 12 it will not leak out therefrom. A flexible jet tube 40 is connected to one of the lateral fluid passageways 20 and extends outwardly through the bristles 22. A longitudinal track 42 is formed within the longitudinal channel 18 in the head 16 below the lateral fluid passageways 20. A three position perforated slide member 44 rides in the longitudinal track 42. The handle 12 has a slot 46 in the one side adjacent the bristles 22 on the head 16. An accordion plate 48 is carried in the slot 46 to seal the slot 46 from leaking water 28. A knob 50 is affixed to one end of the slide member 44, which extends through the accordion plate 48, when the slide member 44 is in its first position water 28 is squirted through the lateral fluid passages 20. When in its second position, water 28 is squirted through the lateral fluid passages 20 and the flexible jet tube 40. When in its third position, water 28 is squirted only through the flexible jet tube 40 for a concentrated jet spray.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A water squirt toothbrush which comprises:

a) a handle having a longitudinally extending fluid chamber;

b) a head attached to a first end of said handle having a longitudinally extending fluid channel connected to said fluid chamber and a plurality of lateral fluid passageways extending inwardly and from one face and terminating in said fluid channel;

c) a plurality of bristles extending outwardly from the one face of said head;

d) means in cooperation with said fluid chamber of said handle and said fluid channel in said head, for squirting water through said lateral fluid passageways past said bristles to rinse off teeth being brushed by said bristles; further including a removable cap threaded onto a second end of said handle, so that water can be introduced within the fluid chamber in said handle when needed; wherein said water squirting means includes:

e) said handle having an aperture in one side thereof;

f) a flexible membrane retained to and covering said aperture in said handle;

g) a spring retained in said aperture under said flexible membrane, so that a hand of a person gripping said handle can press said flexible membrane to squirt water from said fluid chamber into said fluid channel and through said lateral fluid passageways; further including a one-way flap valve mounted at the second end of said handle, so that when the water is introduced within the fluid chamber in said handle it will not leak out therefrom; further including:

h) a flexible jet tube connected to one of said lateral fluid passageways and extending outwardly through said bristles;

i) a longitudinal track formed within said longitudinal channel in said head below said lateral fluid passageways;

j) a three position perforated slide member mounted to ride in said longitudinal track;

k) said handle having a slot in the one side adjacent said bristles on said head;

l) an accordion plate carried in said slot to seal said slot from leaking water; and m) a knob extending through said handle affixed to one end of said slide member, so that when said slide member is in it first position water is squirted through said lateral fluid passageways, when in its second position water is squirted through said lateral fluid passageways and said flexible jet tube and when in its third position water is squirted only through said flexible jet tube for a concentrated jet spray.

2. A water squirt toothbrush as recited in claim 1, wherein a) said handle has a slot in which said slide member is mounted adjacent said bristles;

b) an accordion plate seal is mounted in said slot; and c) said knob extends through said accordion plate.

* * * * *